US009933715B2

(12) United States Patent
Nauka et al.

(10) Patent No.: US 9,933,715 B2
(45) **Date of Patent: *Apr. 3, 2018**

(54) COATED PHOTOCONDUCTORS

(71) Applicant: HEWLETT-PACKARD DEVELOPMENT COMPANY, L.P., Fort Collins, CO (US)

(72) Inventors: Krzysztof Nauka, Palo Alto, CA (US); Zhang-Lin Zhou, San Diego, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/180,566

(22) Filed: Jun. 13, 2016

(65) Prior Publication Data

US 2016/0299445 A1 Oct. 13, 2016

Related U.S. Application Data

(63) Continuation of application No. 14/391,012, filed on Oct. 7, 2014, now Pat. No. 9,366,978.

(51) Int. Cl.

| | |
|---|---|
| ***G03G 5/147*** | (2006.01) |
| ***B05D 7/00*** | (2006.01) |
| ***G03G 5/00*** | (2006.01) |
| ***G03G 5/07*** | (2006.01) |

(52) U.S. Cl.

CPC ..... *G03G 5/14791* (2013.01); *B05D 7/50* (2013.01); *G03G 5/005* (2013.01); *G03G 5/07* (2013.01); *G03G 5/14721* (2013.01); *G03G 5/14734* (2013.01); *G03G 5/14739* (2013.01); *G03G 5/14769* (2013.01); *G03G 5/14778* (2013.01)

(58) Field of Classification Search

CPC .... G03G 5/14791; G03G 5/005; G03G 5/007; G03G 5/1473; G03G 5/14721; G03G 5/14734; G03G 5/14739; G03G 5/14752; G03G 5/14769; G03G 5/14778; B05D 7/50

See application file for complete search history.

(56) References Cited

U.S. PATENT DOCUMENTS

| | | | |
|---|---|---|---|
| 7,132,208 | B2 | 11/2006 | Lee et al. |
| 7,315,722 | B2 | 1/2008 | Kitajima et al. |
| 7,332,369 | B2 | 2/2008 | Veres et al. |
| 7,709,170 | B2 | 5/2010 | Kami |

(Continued)

FOREIGN PATENT DOCUMENTS

| | | |
|---|---|---|
| EP | 2101220 | 9/2009 |
| JP | 4037765 | 6/1992 |

(Continued)

OTHER PUBLICATIONS

International Search Report, Application No. PCT/US2012/044075, dated Feb. 26, 2013, 9 pages.

*Primary Examiner* — Thorl Chea

(74) *Attorney, Agent, or Firm* — Thorpe, North & Western L.L.P.

(57) ABSTRACT

The present disclosure is related to coated photoconductors. In an example, a coated photoconductor can comprise a photoconductor including a substrate having a charge generation layer and charge transport layer adhered thereto and a top coating adhered to the photoconductor.

17 Claims, 6 Drawing Sheets

(56) References Cited

U.S. PATENT DOCUMENTS

| | | | | |
|---|---|---|---|---|
| 8,101,327 | B2 | 1/2012 | Tong et al. | |
| 9,366,978 | B2 * | 6/2016 | Nauka | G03G 5/005 |
| 2007/0166634 | A1 | 7/2007 | Qi et al. | |
| 2007/0212627 | A1 | 9/2007 | Yanagawa et al. | |
| 2009/0047588 | A1 | 2/2009 | Yanus et al. | |
| 2013/0288171 | A1 | 10/2013 | Ganapathiappan et al. | |

FOREIGN PATENT DOCUMENTS

| | | |
|---|---|---|
| WO | 2010104513 | 9/2010 |
| WO | 2013095398 | 6/2013 |
| WO | 2013147864 | 10/2013 |

* cited by examiner

COATED PHOTOCONDUCTORS

CROSS-REFERENCE

This Application is a Continuation of U.S. patent application Ser. No. 14/391,012, filed Jun. 25, 2012, entitled Coated Photoconductors, and is incorporated herein by reference.

BACKGROUND

In many printing systems, it is common practice to develop a hardcopy of an image (e.g. on paper or other print substrate) by using a photoconductive substrate. The photoconductive substrate is selectively charged with a latent electrostatic image having image and background areas. For example, a liquid developer comprising charged toner particles in a carrier liquid can be brought into contact with the surface of the selectively charged photoconductive substrate. The charged toner particles adhere to the image areas of the latent image while the background areas remain clean. The hardcopy material is brought directly or indirectly into contact with the photo-conductive surface in order to transfer the latent image. Variations of this method utilize different ways for forming the electrostatic latent image on a photoreceptor or on a dielectric material.

BRIEF DESCRIPTION OF THE DRAWINGS

Additional features and advantages of the invention will be apparent from the detailed description which follows, taken in conjunction with the accompanying drawings, which together illustrate, by way of example, features of the invention.

Figure 1:
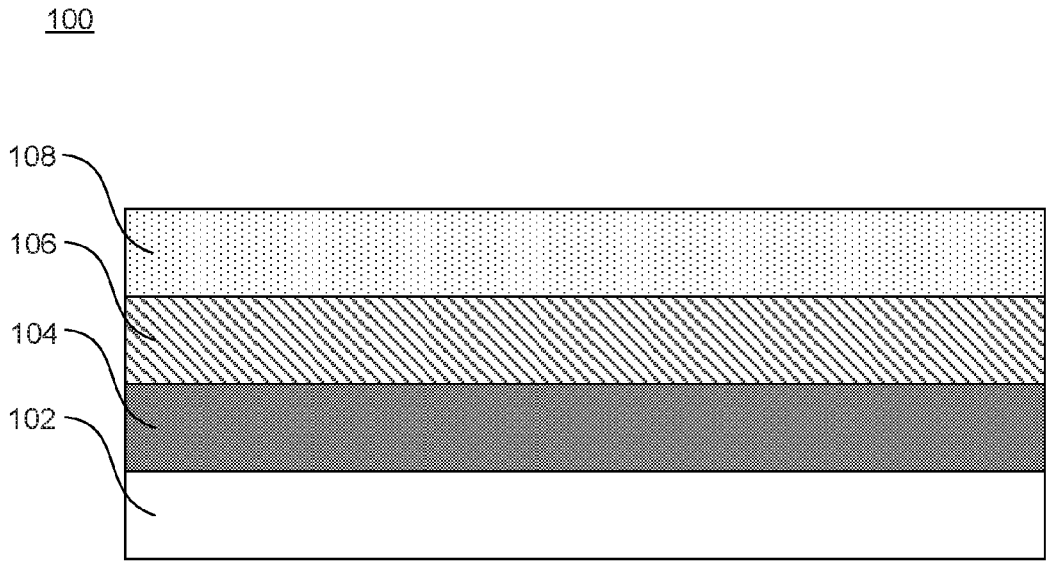
FIG. 1 is a cross section of a coated photoconductor in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It has been recognized that it would be advantageous to develop a photoconductor having extended life in printing systems. In accordance with this, the present disclosure is drawn to coated photoconductor, as well as associated methods involving such coatings. Notably, it has been discovered that the coating of existing photoconductors in printing systems with a cross-linkable polymer and a polymeric dopant extends the life of the photoconductor while preserving the functionality and performance of the latent image former. Additionally, it has been discovered that such coated photoconductors can be used in conjunction quite effectively with liquid electrophotographic (LEP) printing inks.

It is noted that when discussing a coated photoconductor or a method of extending the life of a photoconductor, each of these discussions can be considered applicable to the other embodiment, whether or not they are explicitly discussed in the context of that embodiment. Thus, for example, in discussing a top coating for a coated photoconductor, such a coating can also be used in a method of extending the life of a photoconductor, and vice versa.

Thus, a coated photoconductor can comprise a photoconductor and a top coating adhered to the photoconductor. Generally, the photoconductor includes a substrate having a charge generation layer and charge transport layer adhered thereto. Additionally, the top coating can comprise a cross-linkable polymer, a cross-linker, and a polymeric dopant having a weight average molecular weight of less than 500,000, and can have a thickness of 0.1 μm to 12 μm.

The polymeric dopant can act as a charge transfer material within the top coating allowing charges to pass through the top coating. In one example, the polymeric dopant can have a weight average molecular weight of less than 250,000. In one aspect, the polymeric dopant can have a weight average molecular weight of less than 50,000. The polymeric dopant can be dispersed throughout the top coating and can be present in the top coating in an amount ranging from 0.1 wt % to 10 wt %. Notably, this concentration of weight percent is based on the total weight of the top coating. Alternatively, the charge transport material can be dispersed throughout the top coating and at a concentration wherein the coating provides an OD of at least 0.2 after 300,000 printed images at 20% nominal coverage. In one example, the substrate can be a photo imaging plate in a liquid electrophotographic printer.

Generally, the coatings described herein comprise a cross-linkable polymer and a polymeric dopant. The polymeric dopant generally is present in the top coat in a concentration from 0.1 wt % to 10 wt %. In one example, the polymeric dopant can be present in a concentration from 0.1 wt % to 4 wt %. In another example, the polymeric dopant can be present in a concentration from 0.1 wt % to 2 wt %. Generally, the polymeric dopant can be any short chain polymeric dopant having charge transport properties. In one example, the polymeric dopant can be polyfluorene or its co-polymers with other moieties such as substituted benzothiadiazole derivatives, substituted phenothiazine derivatives, substituted 2,7-diaminocarbazole derivatives, substituted 1,4-diphenylaminobenzene derivatives, and substituted bisphenylbenzidine derivatives; polyanilines or its co-polymers; polythiophenes or its co-polymers; polycarbozoles or its co-polymers; or mixtures thereof.

Regarding the cross-linkable polymer, such a polymer generally comprises polymerized monomers with at least one monomer having cross-linkable functionality. The cross-linkable polymer is generally polymerized from monomers, also refers to as "polymerized monomers." In one example, the polymerized monomers can be selected from acrylates, methacrylates, styrenes, vinyl monomers, combinations thereof, and mixtures thereof. In one aspect, the cross-linkable polymer can comprise a polymerized monomer selected from the group of methyl methacrylate, butyl acrylate, butyl methacrylate, hexyl acrylate, hexyl methacrylate, 2-ethylhexyl acrylate, 2-ethylhexyl methacrylate, lauryl acrylate, lauryl methacrylate, octadecyl acrylate, octadecyl methacrylate, stearyl methacrylate, acrylic acid, methacrylic acid, acrylonitrile, methacrylonitrile, styrene, methylstyrene, combinations thereof, and mixtures thereof. In one example, the cross-linkable polymer can be a copolymer. In one aspect, the cross-linkable polymer can be an acrylate copolymer or a methacrylate copolymer. As also discussed herein, the cross-linkable polymer comprises at least one monomer having cross-linking functionality. Such a cross-linker typically reacts with functional groups on cross-linkable monomers from the same or two discrete polymer strands. In one example, the cross-linker can be selected from the group of polyisocyanates, polyols, polyesters, polyamines, combinations thereof, and mixtures thereof. The cross-linker can be present in the coating from 0.01 wt % to 10 wt % in the dried coating composition and the cross-linkable polymer can be present in the coating in an amount of 50 wt % to 99.9 wt % by solids.

Generally, the present coatings can be used with any type of photoconductors in printing systems, e.g., organic photoconductors. As such, the coated photoconductors generally comprise a charge generation layer and a charge transport layer. The charge generation layer can comprise charge generation materials. The charge generating materials may be classified into inorganic materials and organic materials and both are suitable for use. Examples of inorganic materials include crystalline selenium, amorphous selenium, selenium-tellurium, selenium-tellurium-halogen, selenium-arsenic compound, and amorphous silicon. The amorphous silicon may have dangling bonds terminated with hydrogen atom or a halogen atom, or it may be doped with boron or phosphorus. The organic material may be selected from conventional materials, and examples thereof include phthalocyanine pigments such as metal phthalocyanine, nonmetal phthalocyanine, azulenium salt pigments, aquatic acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxidiazole skeleton, azo pigments having distyrylcarbazole skeleton, perylene pigments, anthraquinone or polycyclic quinone pigments, quinone imine pigments, diphenylmethane pigments, triphenylmethane pigments, benzoquinone pigments, naphtoquinone pigments, cyanine pigments, azomethine pigments, indigoido pigments, or bisbenzimidazole pigments. These charge generating materials may be used alone or in combination.

Additionally, the charge transport layer can comprise hole transport substances and electron transport substances. Examples of electron transport materials include electron-accepting substances such as chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, and diphenoquinones. These electron transport substances may be used alone or in combination. Examples of hole transporting substances include oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, and aromatic tertiary amines. These hole transporting substances may be used alone or in combination. In some examples, the photoconductive substrates can include a single layer comprising charge generation materials and charge transport materials.

Generally, the top coating can have a thickness of 0.1 μm to 12 μm. In one example, the top coating can have a thickness of 0.2 μm to 1 μm. The coatings can be used with photoconductor and still provide acceptable optical density (OD) after considerable printing. In one example, the coating can provide an OD of at least 0.2 after 300,000 impressions at 20% nominal coverage of an LEP ink. In another example, the coating can provide an OD of at least 0.22 after 300,000 impressions at 20% nominal coverage of an LEP ink. In another example, the coating can provide an OD of at least 0.8 after 300,000 impressions at 80% nominal coverage of an LEP ink. In yet another example, the coating can provide an OD of at least 0.84 after 300,000 impressions at 80% nominal coverage of an LEP ink. In one aspect, the LEP ink can be a black LEP ink.

The ink application device can comprises a photo imaging plate for forming an electrostatic image, and a charging unit configured to charge at least a portion of the photo imaging plate forming a latent image. The device can further comprise a binary image developer for applying a liquid toner or liquid electrophotographic ink to the latent image forming a developed image, an intermediate transfer member that receives the developed image, and an impression roller having a substrate that receives the developed image from the intermediate transfer member.

Referring to FIG. 1, a coated photoconductor 100 can comprise a substrate 102 having a charge generation adhered thereto, a charge transport layer 106 adhered to the charge generation layer, and a top coat 108 adhered to the charge transport layer. The top coat generally comprises a cross-linkable polymer, a cross-linker, and a polymeric dopant as discussed herein. While the present figure provides a specific structure of the photoconductor, it is understood that the illustrated structure is not intended to be limiting and that the present disclosure contemplates the use of the present top coat with any number of photoconductors. For example, the present top coat can be applied to a photoconductor that has a single layer that includes charge generation materials and charge transport materials. Thus, reference to a "charge generation layer" and a "charge transport layer" can, in fact, be a single layer comprising both materials, and is defined herein to include this specific arrangement. Alternatively, the "charge generation layer" and the "charge transport layer" is also defined to include two separate and distinct layers applied in either order, though charge generation layer is typically applied beneath the charge transport layer.

Figure 2:
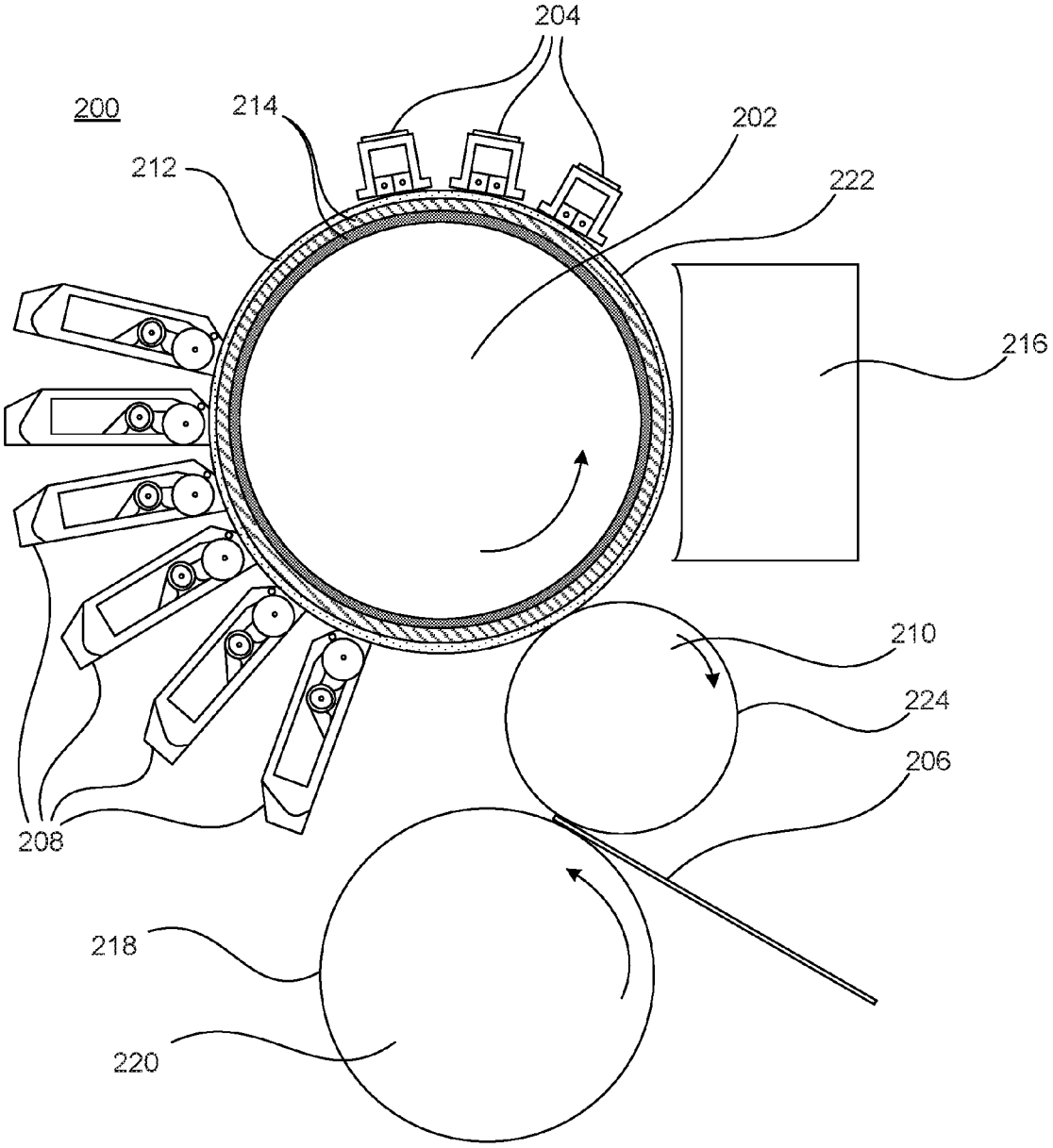
FIG. 2 is a general schematic of one possible print engine from a liquid electrophotographic printer in accordance with one example of the present disclosure.

Referring to FIG. 2, a liquid electrophotographic (LEP) print engine 200 is shown in accordance with one example of the present disclosure. It is noted that the elements of FIG. 2 are not necessarily drawn to scale, nor does it represent every photoconductive printing system available for use herein, i.e. it provides merely an exemplary embodiment of one photoconductive printing system. In this example, the LEP print engine can form a latent image on a photo imaging plate (PIP) 202 by charging at least a portion of the PIP with charging units 204. The charging mechanism can include one or multiple unit charging subunits (not shown) followed by a laser discharging unit (not shown). Typically, the charging of the PIP corresponds to an image which can be printed by the LEP printing engine on a substrate 206. The latent image can be developed by liquid toner/liquid electrophotographic ink from binary image developers (BID) 208. The liquid electrophotographic ink adheres to the appropriately charged areas of the PIP developing the latent image thereby forming a developed image. The developed image can be transferred to an intermediate transfer member (ITM) 210. Additionally, the developed image can be heated on the ITM. The developed image can then be transferred to a substrate as described herein.

The PIP can have a top coating 212 directly applied thereto or can be applied to charge generation and charge transport layer or layers 214 that is applied to the PIP, as shown in FIG. 2. The PIP can be optionally discharged and cleaned by a cleaning/discharging unit 216 prior to recharging of the PIP in order to start another printing cycle. As the substrate passes by the ITM, the developed image located on the ITM can then be transferred to the substrate. Affixation of the developed image to the substrate can be facilitated by locating the substrate on the surface 218 of impression roller 220, which can apply pressure to the substrate by compressing it between the impression roller and the ITM as the image is being transferred to the substrate. Eventually, the substrate bearing the image exits the printer. In one embodiment, the printer can be a sheet-fed printer. In another embodiment, the printer can be a web-fed printer.

FIG. 2 shows a plurality of BID units located on the PIP. In one example, each BID can contain a different colored liquid electrophotographic ink for use in producing multicolor images. Generally, a colored liquid electrophotographic ink can be located in each of the other BID units. The present LEP printer can be a 1-shot process printer that transfers a complete multi-color image to the substrate at one time. For example, if an image is comprised of four color separations (e.g., black, cyan, magenta, and yellow), an exemplary mode of operation could involve charging the PIP with the appropriate pattern for the yellow electrophotographic ink. As the PIP rotates, the BID that contains yellow liquid electrophotographic ink can apply the toner onto the coated PIP surface 222, developing the latent image. The yellow electrophotographic ink image can then be transferred to the ITM surface 224 where it remains, awaiting the deposit of the remaining color layers, i.e. cyan, magenta and black. This cycle can be repeated for each of the remaining colors until a complete multi-colored image is located on ITM. Once the complete image is assembled, it can be deposited all at once onto the substrate. In another embodiment, the LEP printer can transfer each colored liquid electrophotographic ink to the substrate sequentially. Additionally, the LEP printer can include a BID that contains only a wetting substance, such as a carrier liquid used in the liquid electrophotographic ink, for example, or a volatile component thereof such as ISOPAR® L, to improve streaking.

The liquid electrophotographic inks or liquid toners described herein can be any such ink or toners known in the art, including liquid electrophotographic inks that comprise a liquid vehicle, a colorant, a charging component, and optionally, polymer(s). Additionally, other additive may be present in the liquid toner. One or more non-ionic, cationic, and/or anionic surfactant can be present, ranging from 0.01 wt % to 5.0 wt %, if present. The balance of the formulation can comprise other liquid vehicle components known in the art, such as biocides, organic solvents, viscosity modifiers, pH adjusters, sequestering agents, preservatives, compatibility additives, emulsifiers, and the like.

Additionally, a process of manufacturing a photoconductor can comprise applying a top coating to the photoconductor. The photoconductor generally includes a substrate having a charge generation layer and charge transport layer adhered thereto. The top coating comprises a cross-linkable polymer, a cross-linker, and a polymeric dopant and where the polymeric dopant is dispersed throughout the top coating. In one example, the substrate can be a photo imaging plate in a liquid electrophotographic printer. In another example, the top coating can be heated to cross-link the cross-linkable polymer. Such heating can be performed in the range of 50° C. to 200° C. In one aspect, the heating can be from 70° C. to 120° C. Additionally, the process can extend the life of the photoconductor.

Notably, it has thus been discovered that thin coating layers described herein can improve the shelf-life of conductive substrates while maintaining excellent optical density. Additionally, the coatings do not affect or substantially affect any underlying layer of coatings, including charge generation or charge transport layers. Further, the coatings can improve scratch resistance. As such, the present coatings can extend the life of a photoconductive substrate, including those used in LEP applications.

It is noted that, as used in this specification and the appended claims, the singular forms "a," "an," and "the" include plural referents unless the context clearly dictates otherwise.

As used herein, "liquid electrophotographic ink" or "liquid toner" generally refers to an ink having a liquid vehicle, a colorant, a charging component, and polymer(s) used in electrophotographic printing.

As used herein, "liquid electrophotographic printing," "LEP," or "electrostatic printing" generally refers to the process that provides a liquid electrophotographic ink or ink toner image that is electrostatically transferred from a photo imaging plate to an intermediate drum or roller, and then thermally transferred to a substrate, or to the process wherein the ink image is electrostatically transferred from the photo imaging plate directly onto a substrate. Additionally, "liquid electrophotographic printers" generally refer to those printers capable of performing electrophotographic printing, as described above. These types of printers are different than traditional electrophotographic printers that utilized essentially dry charged particles to image a media substrate.

As used herein, "weight average molecular weight" refers to the molecular weight of a polymer calculated by:

$$M_w = \frac{\Sigma_i N_i M_i^2}{\Sigma_i N_i M_i}$$

where $N_i$ is the number of molecules of molecular weight $M_i$. The weight average molecular weight can be determined by light scattering, small angle neutron scattering (SANS), X-ray scattering, and sedimentation velocity.

As used herein, a plurality of items, structural elements, compositional elements, and/or materials may be presented in a common list for convenience. However, these lists are to be construed as though each member of the list is individually identified as a separate and unique member. Thus, no individual member of such list is to be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

EXAMPLES

The following examples illustrate embodiments of the disclosure that are presently known. Thus, these examples should not be considered as limitations of the invention, but are merely in place to teach how to make compositions of the present disclosure. As such, a representative number of compositions and their method of manufacture are disclosed herein.

Example 1—Preparation of 2,7-Dibromofluorene (Compound 2)

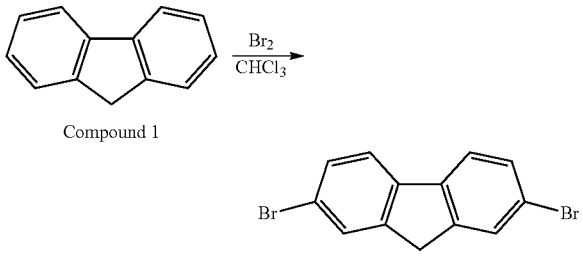

To a solution of fluorene (Compound 1) (30 g, 0.18 mol) and $CHCl_3$ (250 mL), liquid bromine (72 g, 0.45 mol) was added drop by drop under ice-bar, and the reaction mixture was stirred for 24 hr. 50% NaOH aqueous solution was added to remove excess bromine. The separated organic layer was washed with brine and dried over anhydrous $Na_2SO_4$ and chloroform was evaporated under vacuum. The crude product was purified by recrystallization from chloroform to give Compound 2 as a white solid (55.4 g, 95%). $^1H$ NMR (300 MHz, $CDCl_3$, ppm): δ 7.43-7.61 (m, 6H), 3.76 (s, 2H). $^{13}C$ NMR (75 MHz, $CDCl_3$, ppm): δ 144.9, 139.8, 130.3, 128.4, 121.3, 121.1, 36.7. MS m/z: 324 (M+).

Example 2—Preparation of 2,7-dibromo-9,9-bis(6'-bromopropyl)fluorene (Compound 3)

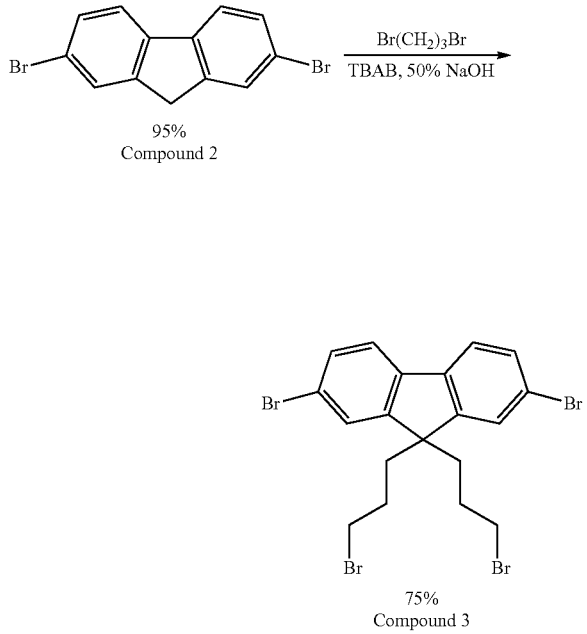

A mixture of 2,7-dibromofluorene (Compound 2 from Example 1) (4.86 g, 15 mmol), 1,4-dibromopropane (30 mL), tetrabutylammonium bromine (0.1 g), and aqueous sodium hydroxide (30 mL, 50% w/w) solution was stirred overnight at 70° C. under nitrogen. After diluting the reaction mixture with chloroform, the organic layer was washed with brine and water. The separated organic layer was dried over anhydrous $Na_2SO_4$ and chloroform was evaporated under vacuum. The excess 1,6-dibromopropane was distilled under vacuum. 9,9-bis(6'-bromopropyl) fluorene (Compound 3) (7.3 g, 75%) was obtained as a white crystal by chromatography with petroleum ether as the eluent. $^1H$ NMR (300 MHz, $CDCl_3$, ppm): δ 7.43-7.56 (m, 6H), 3.28-3.33 (t, 4H, J=6.6 Hz), 1.89-1.95 (m, 4H), 0.53-0.63 (m, 4H). $^{13}C$ NMR (75 MHz, $CDCl_3$, ppm): δ 152.3, 139.2, 130.5, 126.3, 121.7, 121.4, 55.7, 40.2, 27.9, 23.6.

Example 3—Preparation of (3,3'-(2,7-dibromo-9H-fluorene-9,9-diyl)bis(propane-3,1-diyl))bis(tributylphosphonium) bromide (Compound 4)

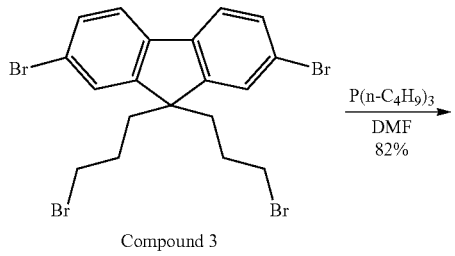

-continued

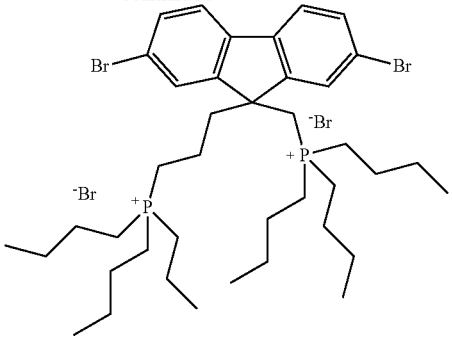

Compound 4

A solution of Compound 3 (from Example 2) (5.6 g, 10 mmol) and $P(n\text{-}C_4H_9)_3$ (5.05 g, 25 mmol) in 40 mL of DMF was heated to reflux overnight. After removal of the solvents under reduced pressure, the residue was purified by crystallization with acetone and ethyl acetate to give Compound 4 as a white solid (7.83 g, 82%). $^1$H NMR (400 MHz, $CDCl_3$, ppm): δ 7.79 (s, 2H), 7.56-7.59 (d, 2H), 7.50-7.52 (d, 2H), 2.36-2.41 (t, 4H), 1.40-1.50 (m, 28H), 0.91-0.95 (t, 18H). Anal. Calcd. for $C_{43}H_{72}Br_4P_2$: C, 53.21; H, 7.48. Found: C, 53.21; H, 7.36. ESI (m/z): [M-Br]: m/z 887.

Example 4—Preparation of 2,7-Bis(4,4,5,5-tetramethyl-1,3,2-dioxaborolan-2-yl)-9,9-dihexylfluorene (Compound 7)

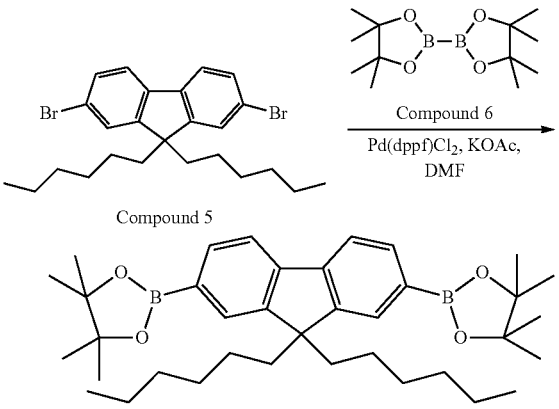

A mixture of 2,7-dibromo-9,9-dihexylfluorene (Compound 5) (15 g, 30.5 mmol), KOAc (18 g, 183 mmol), bis(pinacolato)diborane (Compound 6) (16.4 g, 64 mmol), $Pd(dppf)Cl_2$ (1.8 g, 0.22 mmol) in 150 mL of degassed 1,4-dioxane was stirred for 12 h at 80° C. After the mixture was cooled to room temperature, water and chloroform were added into the mixture, and the separated organic layer was washed with brine, water and dried over anhydrous $Na_2SO_4$. After removal of the solvent under reduced pressure, the residue was purified over silica gel column chromatography with petroleum as the eluent to give the product as a white solid (13.4 g, 75%). $^1$H NMR (300 MHz, $CDCl_3$, ppm): δ 7.70-7.81 (m, 6H), 1.39 (s, 24H), 1.01-1.11 (m, 12H), 0.72-0.76 (t, 6H, J=6.9 Hz).

Example 5—Preparation of Polyfluorene Copolymer CTM (Compound P1)

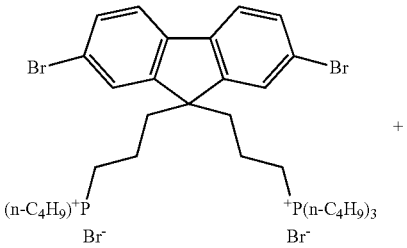

Compound 4

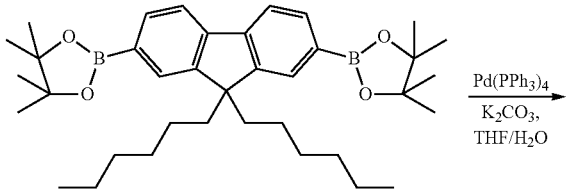

Compound 7

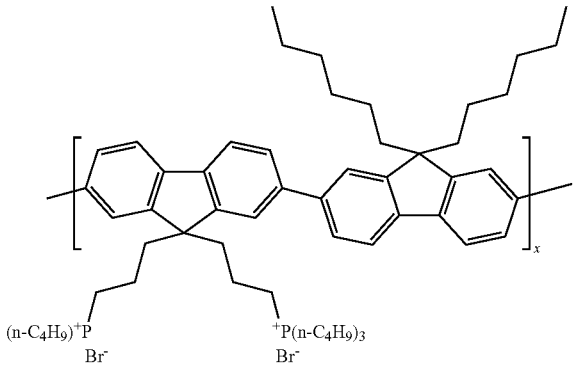

Compound P1

Compound 4 (from Example 3) (500 mg, 0.52 mmol), Compound 7 (from Example 4) (302 mg, 0.52 mmol), $Pd(PPh_3)_4$ (12 mg, 0.02 mmol), and 0.83 g of $K_2CO_3$ were added into a two-neck flask and degassed by $N_2$, then degassed THF (8 mL) and deionized water (4 mL) were injected by syringe. The reaction mixture was stirred under nitrogen purge at 85° C. for 48 h. After cooling to room temperature, water and chloroform were added, the separated organic layer was washed with brine and water and then dried over anhydrous $Na_2SO_4$. After removal of the solvent under reduced pressure, the residue was added to stirred petroleum ether to give a precipitate. The precipitate was dissolved in chloroform and re-precipitated from petroleum ether. The resulting precipitate was placed in a Soxhlet apparatus and extracted with refluxed ethyl acetate for 48 h to remove small molecules and catalyst residue, and then was dried at 60° C. in vacuum oven to give Compound P1 as a yellow solid. $^1$H NMR (300 MHz, $CD_3OD$, ppm): δ 7.58-8.01 (m, 12H), 1.80-2.13 (m, 17H), 0.79-1.72 (m, 86H).

Example 6—Preparation of Polyfluorene Copolymer CTM (Compound P2)

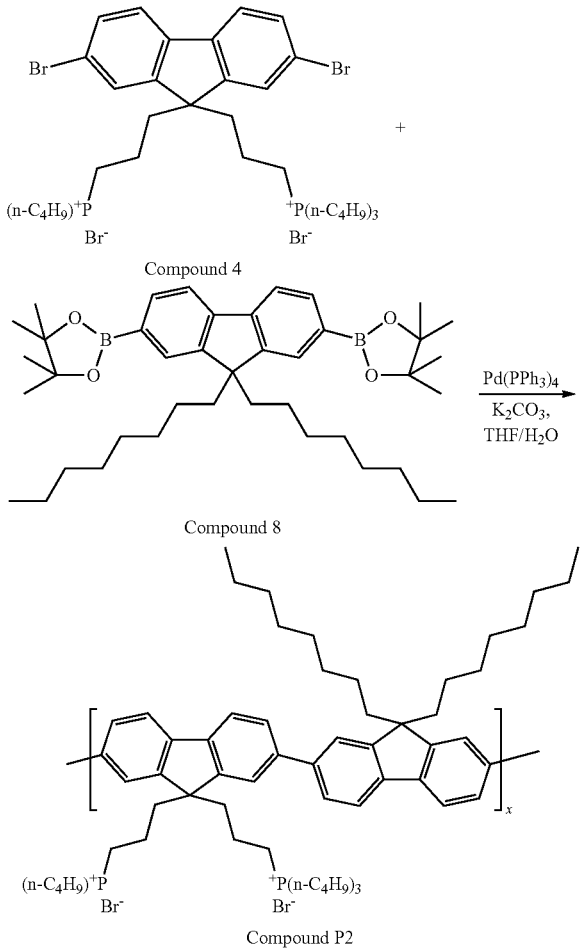

Compound 4 (from Example 3) (500 mg, 0.52 mmol), Compound 8 (334 mg, 0.52 mmol), $Pd(PPh_3)_4$ (12 mg, 0.02 mmol), and 0.83 g of $K_2CO_3$ were added into a two-neck flask and degassed by $N_2$, then degassed THF (8 mL) and deionized water (4 mL) were injected by syringe. The reaction mixture was stirred under nitrogen purge at 85° C. for 48 h. After cooling to room temperature, water and chloroform were added, the separated organic layer was washed with brine and water and then dried over anhydrous $Na_2SO_4$. After removal of the solvent under reduced pressure, the residue was added to stirred petroleum ether to give a precipitate. The precipitate was dissolved in chloroform and reprecipitated from petroleum ether. The resulting precipitate was placed in a Soxhlet apparatus and extracted with refluxed ethyl acetate for 48 h to remove small molecules and catalyst residue, and then was dried at 60° C. in vacuum oven to give Compound P2 as a yellow solid. $^1$H NMR (300 MHz, $CD_3OD$, ppm): δ 7.62-8.03 (m, 12H), 2.14-2.20 (m, 20H), 1.00-1.49 (m, 76H), 0.74-1.00 (m, 28H).

Example 7—Characterization for Polyfluorene Copolymers: Compound P1 of Example 5 and Compound P2 of Example 6

The molecular weights $M_n$ (number average) of these copolymers P1 and P2 were 28,920 and 17,115, respectively, while $M_w$ (weight average) were determined to be 46,382 and 37,208, respectively. The polydispersities (PDI) were found to be 1.60 and 2.17, respectively. The absorption of these two polymers P1 and P2 have been measured in both solution ($10^{-5}$ mol/L concentration) and film. The maximum absorption of P1 and P2 were, respectively, 370 nm and 380 nm in solution and 380 and 388 nm in the film.

Cyclic voltammograms (CVs) of films of the copolymers coated on carbon electrodes in 0.1 mol/L $Bu_4NPF_6$, $CH_3CN$ solution were measured. Based on these CV and the absorption data, the bandgap and HOMO-LUMO energy level may be obtained. For copolymer P1, the energy level of HOMO was determined to be −5.18 eV, that of LUMO was determined to be −2.55 eV, and the energy bandgap was determined to be 2.63 eV. For copolymer P2, the energy level of HOMO was −5.30 eV, that of LUMO was −2.56 eV, and the energy bandgap was 2.74 eV. The HOMO energy level of these polymers indicated that these polymers could be used as good hole transport materials.

Example 8—Formulations of OPC Coating Solutions

For the present formulations, the solvent mixture may include at least one solvent in which the monomer(s) and dopant(s) are both soluble in. Once the monomer(s) and dopant(s) are selected, then an appropriate solvent may be selected. Examples of monomer(s), dopant(s), and solvent(s) are shown in the following examples. Those are just some representative examples, and are not exhaustive of all possible combinations. Based on the teachings herein, a person of ordinary skill in the art can make appropriate selections of these components.

Formulation #1

To a 100 ml bottle were added N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), fluorene based co-polymer of Example 5 (P1) (60 mg), 25 ml of isopropanol and 25 ml of hexafluoro-isopropanol (25 m). The resulting mixture was shaken for one hour. The formulation was ready for use as a high performance OPC coating.

Formulation #2

To a 100 ml bottle were added N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), fluorene based co-polymer of Example 6 (P2) (60 mg), 25 ml of isopropanol and 25 ml of hexafluoro-isopropanol (25 m). The resulting mixture was shaken for one hour. The formulation was ready for use as a high performance OPC coating.

Formulation #3

To a 100 ml bottle were added Norland 83 H (Norland 83 H is a commercially available product from Nordland Products that includes monomers, cross-linkers, and initiator) (180 mg), fluorene based co-polymer of Example 6 (P2) (30 mg), 25 ml of isopropanol and 25 ml of hexafluoro-isopropanol (25 m). The resulting mixture was shaken for one hour. The formulation was ready for use as a high performance OPC coating.

Formulation #4

To a 100 ml bottle were added Norland 85 (Norland 85 is a commercially available product from Nordland Products that includes monomers, cross-linkers, and initiator) (180 mg), fluorene based co-polymer of Example 6 (P2) (30 mg), 25 ml of isopropanol and 25 ml of hexafluoro-isopropanol (25 m). The resulting mixture was shaken for one hour. The formulation was ready for use as a high performance OPC coating.

Formulation #5

To a 100 ml bottle, N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), carbazole based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #6

To a 100 ml bottle, Norland 81 (Norland 81 is a commercially available product from Nordland Products that includes monomers, cross-linkers, and initiator) (180 mg), carbazole based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #7

To a 100 ml bottle, N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), benzothiadiazole based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #8

To a 100 ml bottle, Norland 78 (Norland 78 is a commercially available product from Nordland Products that includes monomers, cross-linkers, and initiator) (180 mg), benzothiadiazole based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #9

To a 100 ml bottle, N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), phenothiazine based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #10

To a 100 ml bottle, Norland 84 (Norland 84 is a commercially available product from Nordland Products that includes monomers, cross-linkers, and initiator) (180 mg), phenothiazine based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #11

To a 100 ml bottle, N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), diaminocarbazole based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #12

To a 100 ml bottle, Norland NEA 121 (Norland NEA 121 is a commercially available product from Nordland Products that includes monomers, cross-linkers, and initiator) (180 mg), diaminocarbazole based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #13

To a 100 ml bottle, N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), 1,4-diphenylaminobenzene based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #14

To a 100 ml bottle, Norland NOA 88 (Norland NOA 88 is a commercially available product from Nordland Products that includes monomers, cross-linkers, and initiator) (180 mg) 1,4-diphenylaminobenzene based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #15

To a 100 ml bottle, N-vinylpyrrolidone (55 mg), ethoxylated bisphenol A dimethylacrylate (150 mg), trimethylolpropane trimethylacrylate (200 mg) and tert-butoxy-3,5,7-trimethylhexanoate (20 mg), bisphenylbenzidine based co-polymer (60 mg), 25 ml of isopropanol and 25 ml of hexafluoro-isopropanol (25 m) are added. The resulting mixture is shaken for one hour. The formulation is ready for use as a high performance OPC coating.

Formulation #16

To a 100 ml bottle, Norland NBA 108 (Norland NBA 108 is a commercially available product from Nordland Products that includes monomers, cross-linkers, and initiator) (180 mg), bisphenylbenzidine based co-polymer (60 mg), 25 ml of isopropanol and 25 ml of hexafluoro-isopropanol (25 m) are added. The resulting mixture is shaken for one hour. The formulation is ready for use as a high performance OPC coating.

Example 9—Cracking of Coated Photoconductor

Figure 3:
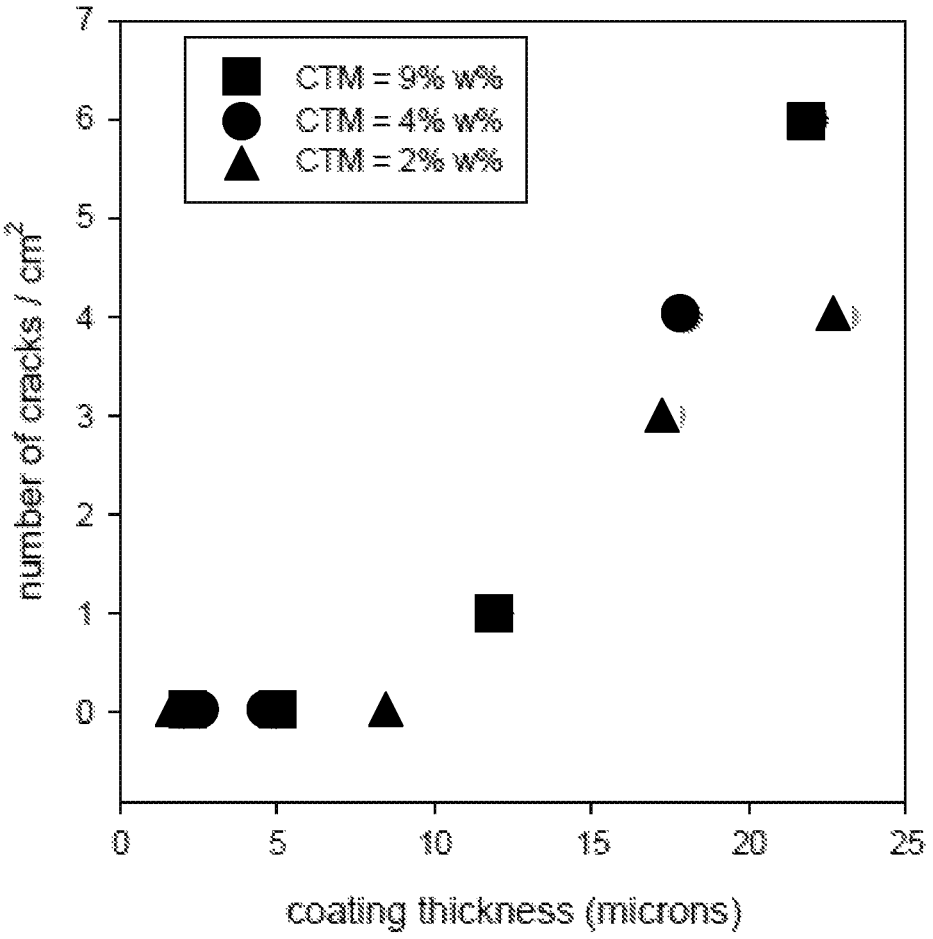
FIG. 3 is a graph of cracks vs. coating thickness for a coated photoconductor after 10,000 impressions in accordance with certain examples of the present disclosure.

Formulation #3 from Example 8 was coated onto PIPs of LEP printers using a drawing wire roller to form coatings with varying thicknesses and CTM concentrations as shown in FIG. 3 (after solvent evaporated). In addition, the coated photoconductor was annealed at 90° C. for 1 hour to remove any residual solvent.

The thickness varied between 0.8 μm and 25 μm, while polymeric CTM concentration in inert cross-linked matrix ranged from 2 wt % to 9 wt %. Print testing consisted of printing 10K impressions of monocolor Gray dots on HP Indigo series 3 presses providing nominal 0.2 OD (optical density). After printing, an average dot area was measured with the help of spectrodensitometer and OPC coating was evaluated for presence of cracks using a microscope (soaking the OPC in Isopar® L caused polymer swelling in the vicinity of a crack providing a good optical contrast for the optical imaging).

As shown in FIG. 3, no cracking was observed for coating thicknesses of less than 10 μm. Additionally, very little (1 or less) cracking was observed for coating thicknesses of about 15 μm or less.

Example 10—Loading Effect of Polymeric Dopant

Figure 4:
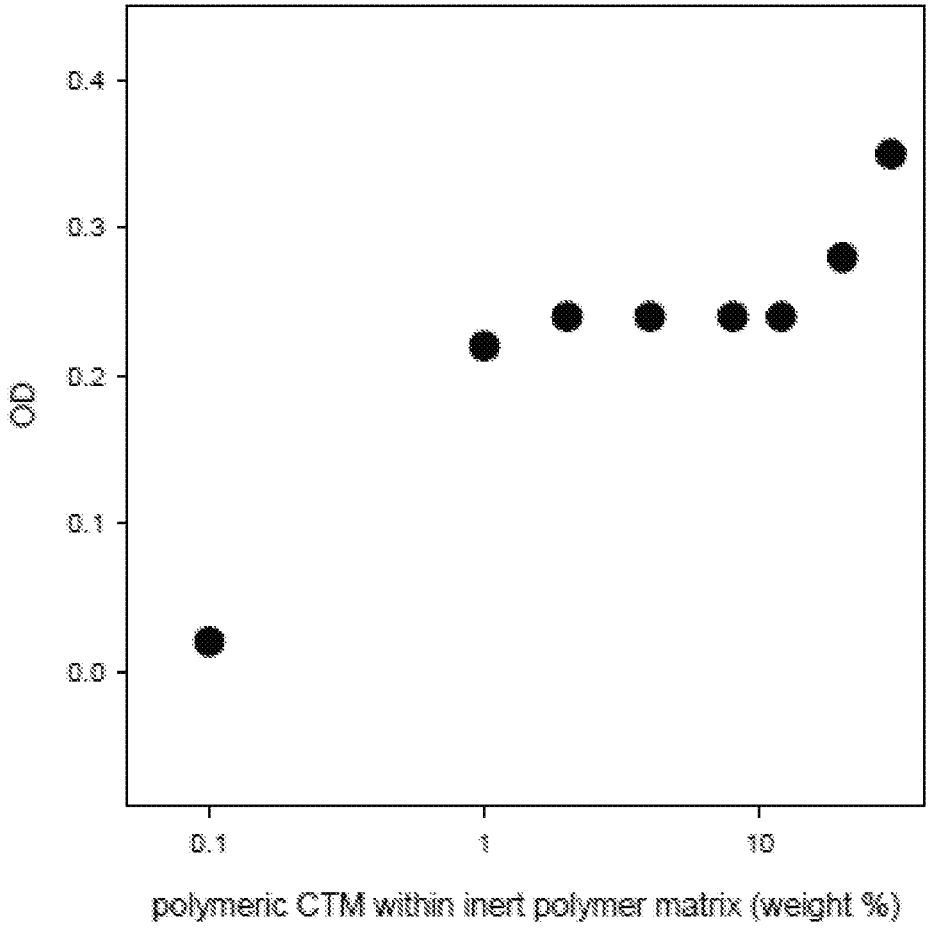
FIG. 4 is a graph of OD vs. polymeric dopant concentration for various coated photoconductors after 10,000 impressions in accordance with certain examples of the present disclosure.

The effect of loading of polymeric dopant was also measured against OD values. As shown in FIG. 4, acceptable OD was provided using polymeric dopant concentration between 0.1 wt % and 10 wt % of the inert polymer matrix (top coat). For the data in FIG. 4, 10,000 impressions were made using Formulation #3 of Example 8 but varying the polyfluroene copolymer concentration as shown in FIG. 4. The impressions were prepared at 20% coverage black dots printed with HP Indigo series 3 presses. As shown in FIG. 4, stable OD coverage is shown for concentration of about 10 wt % and less.

Example 11—Print Degradation of Coated Photoconductors

Figure 5:
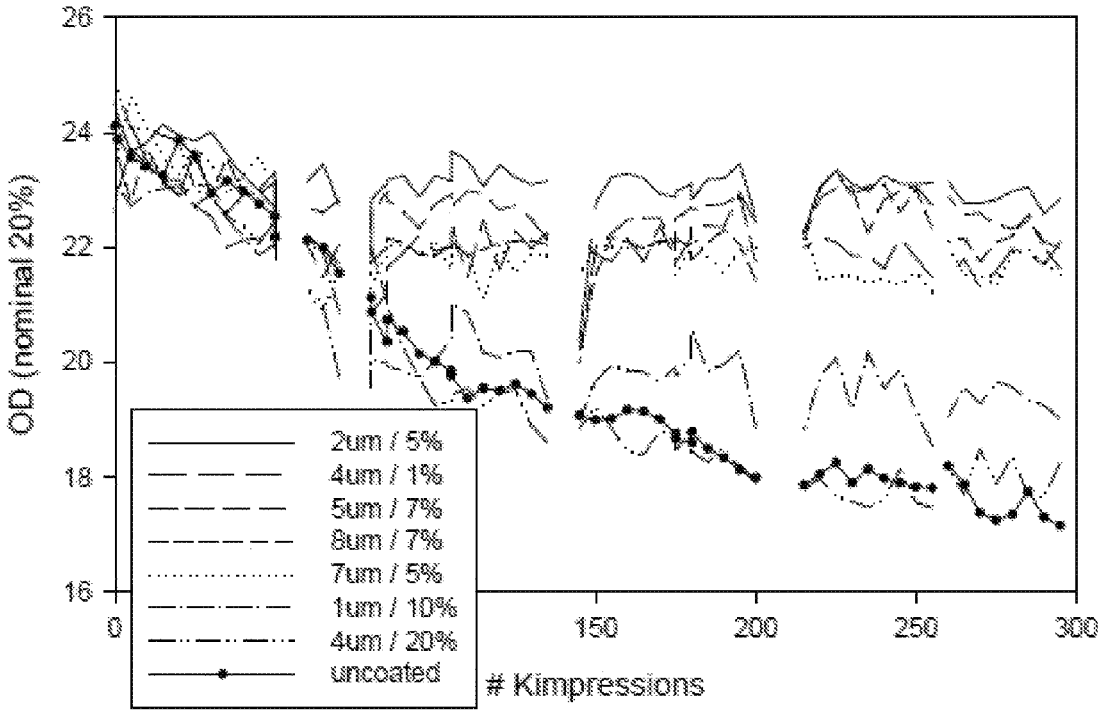
FIG. 5 is a graph of OD vs. number of impressions for various coated photoconductors showing print degradation in accordance with certain examples of the present disclosure.

Print degradation was studied for the coated photoconductors as shown in FIG. 5. As shown in FIG. 5, lower coating thicknesses (less than 2-5 μm) and lower polymeric dopant concentrations (less than 10 wt %) provided the best OD. For the data in FIG. 5, up to 300,000 impressions were made using Formulation #3 of Example 8 but varying the polyfluroene concentrations and top coat thicknesses as shown in FIG. 5. The impressions were prepared at 20% coverage black dots printed with HP Indigo series 3 presses.

Figure 6:
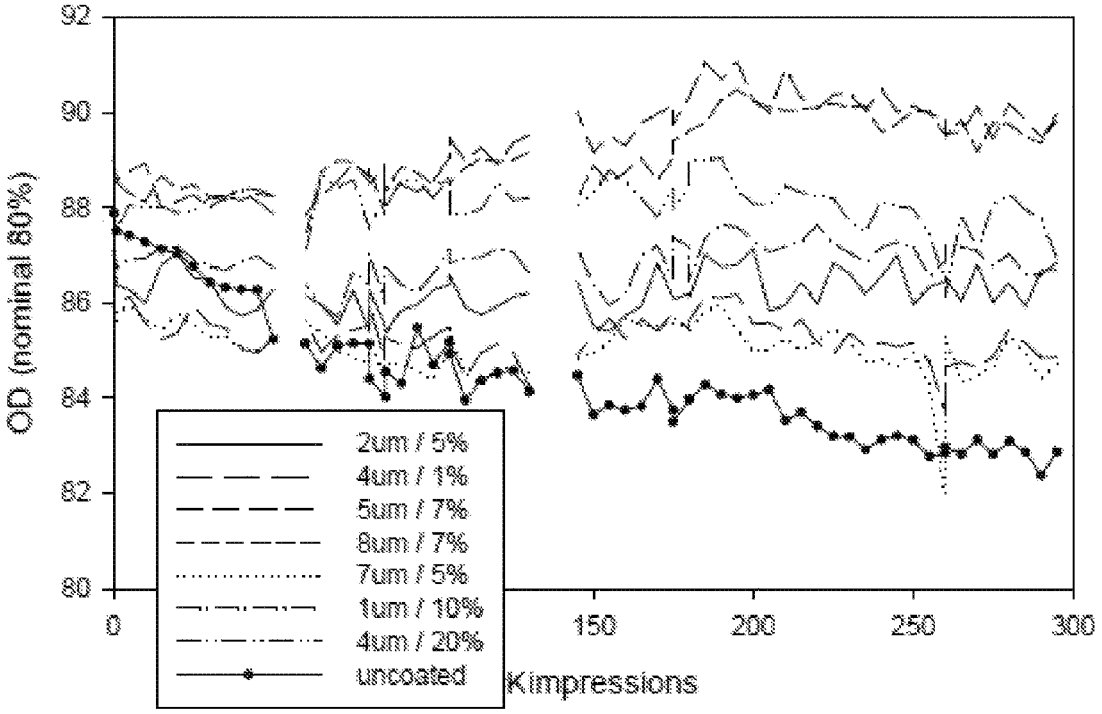
FIG. 6 is a graph of OD vs. number of impressions for various coated photoconductors showing print degradation in accordance with certain examples of the present disclosure.

Additionally, corresponding data obtained for 80% gray level prints was provided in FIG. 6. Similarly to 20% gray level, the most stable OD during an extended printing (for at least 300,000 impressions) occurs when coating thickness is at around 2 microns, and the polymeric dopant concentration is less than 10% of the top coating.

While the invention has been described with reference to certain examples, those skilled in the art will appreciate that various modifications, changes, omissions, and substitutions can be made without departing from the spirit of the invention. It is intended, therefore, that the invention be limited only by the scope of the following claims.

What is claimed is:

1. A coated photoconductor, comprising:

a photoconductor including a substrate having a charge generation layer and charge transport layer adhered thereto; and a top coating adhered to the photoconductor and comprising a cross-linkable polymer, a cross-linker, and a polymeric dopant having charge transport properties, wherein the polymeric dopant is selected from the group of polyfluorenes; polyanilines; polythiophenes; polycarbozoles; and mixtures thereof.

2. The coated photoconductor of claim 1, wherein the top coating has a thickness of 0.1 μm to 12 μm.

3. The coated photoconductor of claim 2, wherein the top coating has a thickness of 0.2 μm to 1 μm.

4. The coated photoconductor of claim 2, wherein the polymeric dopant is present in the top coating at a concentration of 0.1 wt % to 10 wt %.

5. The coated photoconductor of claim 4, wherein the polymeric dopant is present in the top coating at a concentration of 0.1 wt % to 2 wt %.

6. The coated photoconductor of claim 1, wherein the polymeric dopant has a weight average molecular weight of less than 500,000.

7. The coated photoconductor of claim 1, wherein the polymeric dopant comprise a polyfluorene copolymer having a weight average molecular weight of less than 50,000.

8. The coated photoconductor of claim 1, wherein the substrate is a photo imaging plate of a liquid electrophotographic printer.

9. The coated photoconductor of claim 1, wherein the cross-linkable polymer comprises at least one of:

polymerized monomers selected from acrylates, methacrylates, styrenes, vinyl monomers, and combinations thereof; and a polymerized monomer selected from the group of methyl methacrylate, butyl acrylate, butyl methacrylate, hexyl acrylate, hexyl methacrylate, 2-ethylhexyl acrylate, 2-ethylhexyl methacrylate, lauryl acrylate, lauryl methacrylate, octadecyl acrylate, octadecyl methacrylate, stearyl methacrylate, acrylic acid, methacrylic acid, acrylonitrile, methacrylonitrile, styrene, methylstyrene, and combinations thereof.

10. The coated photoconductor of claim 1, wherein the cross-linkable polymer comprises at least one of:

an acrylate copolymer;

a methacrylate copolymer;

the cross-linkable polymer selected from the group of polyisocyanates, polyols, polyesters, polyamines, and combinations thereof.

11. The coated photoconductor of claim 1, wherein the charge generation layer comprises charge generation materials selected from the group of crystalline selenium, amorphous selenium, selenium-tellurium, selenium-tellurium-halogen, selenium-arsenic compound, amorphous silicon, phthalocyanine pigments, metal phthalocyanine, non-metal phthalocyanine, azulenium salt pigments, aquatic acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxidiazole skeleton, azo pigments having distyrylcarbazole skeleton, perylene pigments, anthraquinone quinone pigments, polycyclic quinone pigments, quinone imine pigments, diphenylmethane pigments, triphenylmethane pigments, benzoquinone pigments, naphtoquinone pigments, cyanine pigments, azomethine pigments, indigoido pigments, bisbenzimidazole pigments, and mixtures thereof.

12. The coated photoconductor of claim 1, wherein the charge transport layer comprises charge transport materials selected from the group of chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, diphenoquinones, oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, aromatic tertiary amines, and mixtures thereof.

13. The coated photoconductor of claim 1, wherein the top coating provides an optical density of at least 0.2 after 300,000 printed images at 20% nominal coverage and provides an optical density of at least 0.8 after 300,000 impressions at 80% nominal coverage.

14. The coated photoconductor of claim 1 wherein the polyfluorenes comprise polyfluorene co-polymers, the polyanilines comprise polyaniline co-polymers, the polythiophenes comprise polythiophene co-polymers, and the polycarbozoles comprise polycarbozole co-polymers.

15. A process of manufacturing a photoconductor, comprising applying a top coating to the photoconductor, the photoconductor including a substrate having a charge generation layer and charge transport layer adhered thereto, wherein the top coating comprises a cross-linkable polymer, a cross-linker, and a polymeric dopant having charge transport properties, and wherein the polymeric dopant is dispersed throughout the top coating, and wherein the polymeric dopant is selected from the group of polyfluorenes, polyanilines, polythiophenes, polycarbozoles, and mixtures thereof.

16. The process of claim 15 wherein the polyfluorenes comprise polyfluorene co-polymers, the polyanilines comprise polyaniline co-polymers, the polythiophenes comprise polythiophene co-polymers and the polycarbozoles comprise polycarbozole co-polymers.

17. The process of claim 15, wherein the polymeric dopant is a polyfluorene copolymer having a weight average molecular weight of less than 50,000.

* * * * *